US007344324B2

(12) United States Patent
Sawai

(10) Patent No.: US 7,344,324 B2
(45) Date of Patent: Mar. 18, 2008

(54) IMAGE FORMING APPARATUS HAVING A MEMBER FOR PRESSING A PRINT HEAD ELEMENT AGAINST A PLATEN ROLLER

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/189,979

(22) Filed: Jul. 27, 2005

(65) Prior Publication Data

US 2006/0034648 A1 Feb. 16, 2006

(30) Foreign Application Priority Data

Aug. 16, 2004 (JP) ..... 2004-236777

(51) Int. Cl.
*B41J 2/315* (2006.01)

(52) U.S. Cl. ..... 400/120.16; 400/120.17; 400/120.01; 400/691; 400/693; 101/93.47; 101/93.24; 347/220

(58) Field of Classification Search ..... 400/120.16, 400/120.01, 691, 693; 101/93.24, 47; 347/220, 347/197, 198
See application file for complete search history.

(56) References Cited

U.S. PATENT DOCUMENTS 5,272,488 A * 12/1993 Kim ..... 347/220
5,886,725 A * 3/1999 Miyadera et al. ..... 347/197
7,014,376 B2 * 3/2006 Maruyama et al. .... 400/120.01
7,121,748 B1 * 10/2006 Sawai ..... 400/120.16
7,278,793 B2 * 10/2007 Sawai ..... 400/120.16

FOREIGN PATENT DOCUMENTS

JP 05318852 A * 12/1993
JP 05318857 A * 12/1993
JP 08-295063 A 11/1996
JP 09-131942 A 5/1997
JP 2000-318256 A 11/2000

* cited by examiner

*Primary Examiner*—Ren Yan
*Assistant Examiner*—Matthew Marini
(74) *Attorney, Agent, or Firm*—Global IP Counselors, LLP

(57) ABSTRACT

The image forming apparatus includes the print unit pivotably supported by the chassis, and the pivoting member rotatably supported by the support rod. The print unit has arm portions and the print head element. One of the arm portions has a downward facing portion. The pivoting member has a first side part configured to receive driving force from the motor in first and second rotational directions, and a second side part relatively unrotatably coupled to the first side part. The first side part is integrally provided with a lifting projection, which is configured to engage the downward facing portion of the print unit from below and move the print unit in a direction away from the platen roller while the pivoting member is pivoted in the first rotational direction. It is possible to reduce the number of members for moving the print unit away from the platen roller.

9 Claims, 10 Drawing Sheets

PRIOR ART

IMAGE FORMING APPARATUS HAVING A MEMBER FOR PRESSING A PRINT HEAD ELEMENT AGAINST A PLATEN ROLLER

BACKGROUND OF THE INVENTION

1. Field of the Invention

The present invention relates to an image forming apparatus. More specifically, the present invention relates to an image forming apparatus having a member for pressing a print head element against a platen roller.

2. Background Information

Also, heat transfer printers are known as an example of an image forming apparatus. Such conventional image forming apparatus includes a print unit pivotably supported to a chassis, and a platen roller rotatably supported to the chassis. The print unit is normally urged in a direction away from the platen roller by a torsion coil spring, and is pressed against the platen roller by pressing members. The pressing members are pivotably supported to the chassis via an axle. One of the pressing members is pivoted by a motor. The pivoting of the pressing member is transmitted to the other of the pressing member via the axle, which is coupled to the pressing members relatively unrotatably. Accordingly, the pressing members together apply pressure to the print unit.

As shown in FIGS. 17 and 18, the axle 105 has insertion parts 105*a* and formed near both ends of the axle 105 in oval shapes. The insertion parts 105*a* are tightly and relatively unrotatably inserted respectively into oval-shaped insertion holes 106*a* and 107*a* of the pressing members 106 and 107. Also, bearing supports 105*b* are formed at the ends of the axle 105, at the outer sides of the insertion parts 105*a*. The bearing supports 105*b* are rotatably supported in the insertion holes of the chassis. Press springs 106*b* and 107*b* that exert pressure on the print unit 102 are mounted on the pressing members 106 and 107, respectively.

FIG. 19 is a schematic side plan view illustrating the operation in which the print unit applies pressure to the platen roller. Since the pressing members 106 and 107 are mounted on the axle 105 tightly and relatively unrotatably, the axle 105 and the pressing member 107 shown in FIGS. 17-18 are pivoted as the pressing member 106 is pivoted by the motor. The print unit 102 is thereby pressed on by the press spring 107*b* of the pressing member 107, as well as by the press spring 106*b* of the pressing member 106. As a result, the thermal head unit 102*b* of the print unit 102 is pressed against the platen roller 103 despite the urging force of the torsion coil spring 109.

The conventional heat transfer printer shown in FIGS. 17 through 19 requires the two pressing members 106 and 107 with the respective press springs 106*b* and 107*b*, and the axle 105 are provided to press the thermal head unit 102*b* against the platen roller 103. Thus, the number of components required for pressing the thermal head unit 102*b* against the platen roller 103 is large. Furthermore, since the torsion coil spring 109 is required to urge the thermal head unit 102*b* away from the platen roller 103, the number of requisite components is even greater.

In view of the above, it will be apparent to those skilled in the art from this disclosure that there exists a need for an improved image forming apparatus that overcomes the problems of the conventional art. This invention addresses this need in the art as well as other needs, which will become apparent to those skilled in the art from this disclosure.

SUMMARY OF THE INVENTION

An object of this invention is to allow the number of components for pressing a print head element against a platen roller in an image forming apparatus.

The image forming apparatus according to the first aspect of the present invention includes a chassis; a print unit pivotably supported by the chassis and having arm portions and a print head element supported by the arm portions, one of the arm portions having a downward facing portion; a platen roller rotatably supported by the chassis so as to face the print unit; a motor; an elastically deformable support rod by the chassis; and a pivoting member rotatably supported by the support rod. The pivoting member has a first side part that is configured to receive driving force from the motor in first and second rotational directions, and a second side part that is relatively unrotatably coupled to the first side part. The first side part is integrally provided with a lifting projection, the lifting projection of the pivoting member being configured to engage the downward facing portion of the print unit from below and move the print unit in a direction away from the platen roller while the pivoting member is pivoted in the first rotational direction. The second side part is provided with a pressing part, which is configured to press the print head element against the platen roller when the pivoting member is pivoted in the second rotational direction.

In the image forming apparatus according to the first aspect, a lifting projection for moving the print head element away from the platen roller is integrally provided to the first side surface of the pivoting member, and the print unit is provided with a downward facing portion that is configured to engage the lifting projection. Accordingly, the number of components can be reduced in comparison with cases in which a member for moving the print head element away from the platen roller is provided separately.

In the image forming apparatus according to the second aspect of the present invention, the pressing part of the pivoting member includes a curved portion that maintains contact with the print unit when the pivoting member is pivoted in the first rotational direction and the print unit is separated from the platen roller. With such a configuration, the print unit can be prevented from wobbling due to the curved portion maintaining contact with the print unit when the print head element is separated from the platen roller.

In the image forming apparatus according to the third aspect of the present invention, the pressing part of the pivoting member includes a flat portion, such that the pivoting member is prevented from pivoting further in the second rotational direction when the flat portion presses the print unit.

With such a configuration, the position at which the pressing part of the pivoting member comes into contact with the print unit can be prevented from changing, and the pressure applied to the print unit of the pivoting member can therefore be prevented from changing. The pressure applied to the platen roller by the print head element can accordingly be prevented from changing, and printing irregularities can be prevented from occurring.

In the image forming apparatus according to the fourth aspect of the present invention, the pivoting member is integrally provided with a movement preventing projection that is configured to abut on the arm portion of the print unit from the side. With such a configuration, the position at which the pressing part of the pivoting member comes into contact with the print unit can be prevented from shifting along the axial direction of the support rod. It is therefore possible to prevent a change in the pressure of the pivoting member applied to the print unit as a result of shifting of the contact position of the pressing part on the print unit. As a result, printing irregularities can be prevented from occurring.

In the image forming apparatus according to the fifth aspect of the present invention, the pressing part is configured to press the print head element against the platen roller with a biasing force from elastic deformation of the support rod when the pivoting member is pivoted in the second rotational direction.

Here, the pivoting member includes a first side surface and a second side surface provided with a pressing part for pressing the print head element against the platen roller. The image forming apparatus has an elastically deformable support rod for supporting the pivoting member. The pressing part of the pivoting member uses the pressure from elastic deformation of the support rod to press the print head element against the platen roller. Accordingly, it is possible to dispense with a spring member other than the support rod to press the head print element against the platen roller. As a result, the number of components for pressing the print head element against the platen roller can be reduced.

In the image forming apparatus according to the sixth aspect of the present invention, the lifting projection is a plate shaped projection.

In the image forming apparatus according to the seventh aspect of the present invention, the lifting projection is a L-shaped projection with a rounded corner.

In the image forming apparatus according to the eighth aspect of the present invention, the pivoting member has a U-shaped cross section.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Referring initially to FIGS. 1-13, a heat transfer printer, which is an example of the image forming apparatus in accordance with a first embodiment of the present invention, is illustrated.

Figure 1:
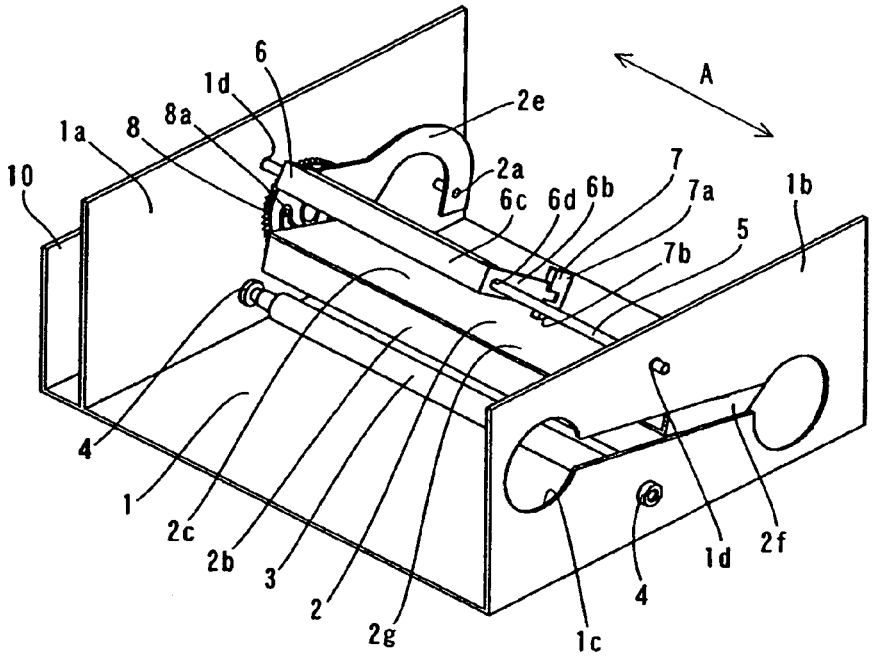
FIG. 1 is a perspective view of the image forming apparatus according to the first embodiment of the present invention.
Figure 2:
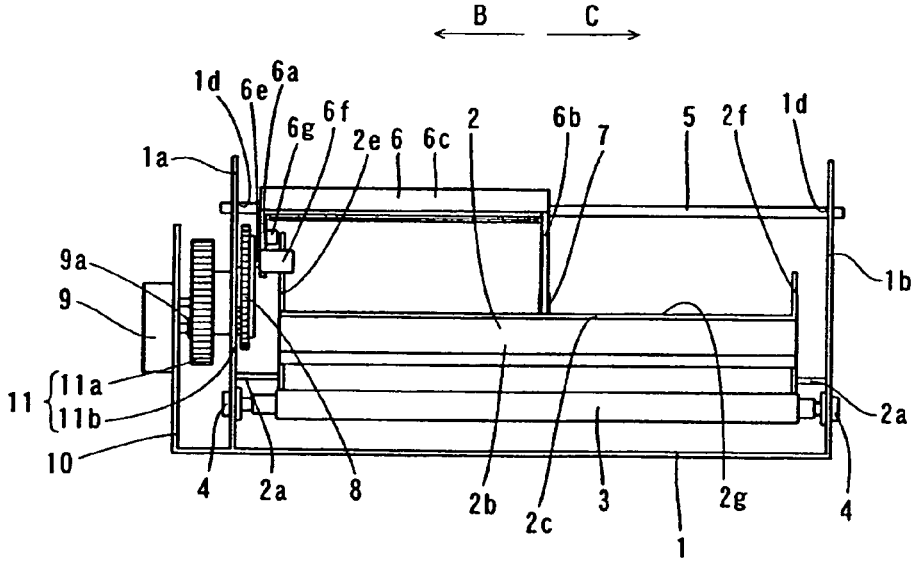
FIG. 2 is a front view of a image forming apparatus according to the first embodiment of the present invention.

FIG. 1 is a perspective view showing the entire structure of a heat transfer printer according to the first embodiment of the present invention. FIG. 2 is a front view of a heat transfer printer according to the first embodiment. FIGS. 3 through 8 are diagrams illustrating the structure of the heat transfer printer according to the first embodiment. FIGS. 9 through 13 are diagrams illustrating the state of the pivoting member pressed on the print unit in the heat transfer printer according to the first embodiment.

First, the structure of the heat transfer printer according to the first embodiment of the present invention will be described with reference to FIGS. 1 through 13. In the present embodiment, a heat transfer printer is described as an example of the image forming apparatus of the present invention.

As shown in FIG. 1, the heat transfer printer according to the first embodiment of the present invention includes a metal chassis 1; a print unit 2 that performs printing; a platen roller 3; a platen roller bearing 4 that rotatably supports the platen roller 3; an elastically deformable support rod 5 made from a piano wire having a diameter of about 3 mm; a metal pivoting member 6; a resinous pressing part 7; a resinous drive gear 8 with a cam groove 8*a* formed on its side face; a motor 9 (see FIG. 2) having a motor axle gear 9*a* (see FIG. 2); a metal motor bracket 10; and an intermediate gear 11 (see FIG. 2) having a large gear 11*a* (see FIG. 2) that engages the motor axle gear 9*a* and a small gear 11*b* (see FIG. 2) that receiving the rotational torque from the large gear 11*a* and engages the drive gear 8. The heat transfer printer may include various other gears that receive the driving force from the motor 9, although they are not shown in FIG. 2.

An ink sheet insertion portion 1*c* through which ink sheets (not shown) are mounted is provided to the second side part 1*b*. The second side part 1*b* faces the first side part 1*a*, on which the motor bracket 10 of the chassis 1 is mounted.

The print unit 2 is mounted in between the first side part 1*a* and the second side part 1*b* of the chassis 1, so as to be capable of pivoting around support axles 2*a*. A thermal head unit 2*b* is provided at the bottom of the print unit 2. The thermal head unit 2*b* is an example of the "print head element" of the present invention. The thermal head unit 2*b* is also disposed so as to face the platen roller 3.

Furthermore, a heat sink 2*c* having a heat radiating function is provided at the top of the thermal head unit 2*b*. Still furthermore, an engaging part 2*d* (an example of the downward facing portion, see FIG. 6) which engages the pivoting member 6, is provided integrally to the heat sink 2*c* adjacent to the first side part 1*a* of the chassis 1. Also, the heat sink 2*c* is provided with a first arm 2*e* and a second arm 2*f*, which both have support axles 2*a*.

The first side part 1*a* and second side part 1*b* of the chassis 1 are provided with insertion holes 1*d*, through which the elastically deformable support rod 5 is inserted. Both ends of this elastically deformable support rod 5 are rotatably inserted through the insertion holes 1*d*. The pivoting member 6 is pivotably mounted on the support rod 5.

Figure 3:
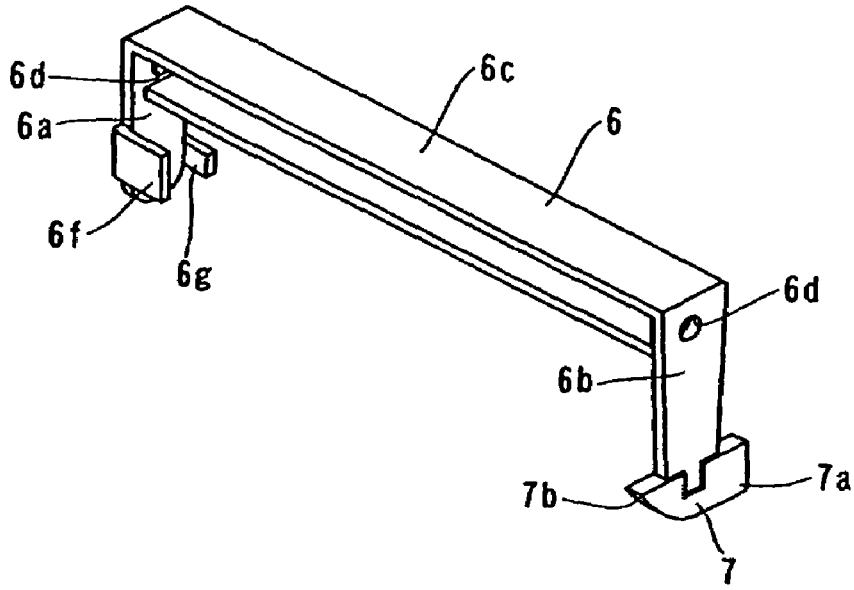
FIG. 3 is a perspective view of the pivoting member of the image forming apparatus according to the first embodiment of the present invention.
Figure 7:
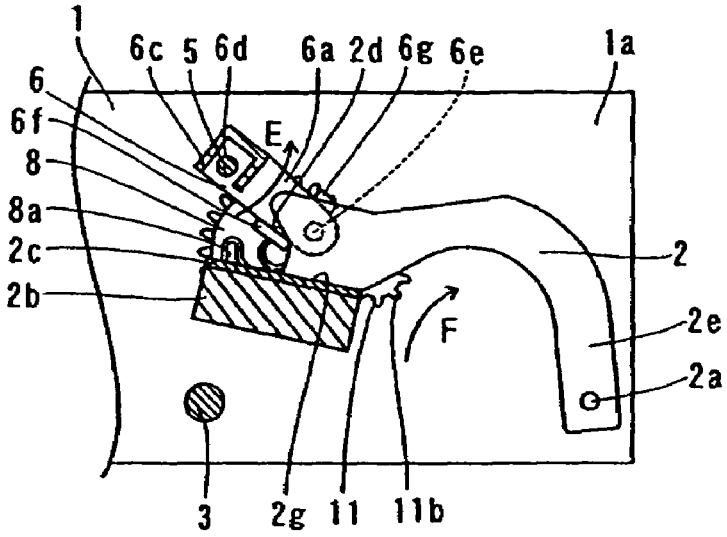
FIG. 7 is a schematic side view showing the positional relationship between the print unit and the first side part of the pivoting member of the image forming apparatus according to the first embodiment of the present invention, when the pivoting member is no pressing the print unit.

In the present embodiment, the pivoting member 6 is formed into the shape of a U as shown in FIG. 3, with a first side part 6*a*, a second side part 6*b*, and a linking part 6*c* that links the first side part 6*a* and the second side part 6*b*. The first side part 6*a* and the second side part 6*b* of the pivoting member 6 are provided with holes 6*d* in which the support rod 5 is mounted (see FIG. 1). Also, the first side part 6*a* of the pivoting member 6 is provided with a cam pin 6*e* (see FIG. 5) that engages with the cam groove 8*a* (see FIG. 7) of the drive gear 8. The engagement of the cam pin 6*e* with the cam groove 8*a* can prevent the pivoting member 6 from being shifted in the direction of arrow B shown in FIG. 2. Furthermore, a lifting part 6*f* (an example of the lifting projection) is a plate-shaped projection that is integrally and unitarily provided to the first side part 6*a* of the pivoting member 6, as shown in FIG. 3. The lifting part 6*f* is formed so as to separate the thermal head unit 2*b* away from the platen roller 3 by engaging with the engaging part 2*d* of the print unit 2 from below, as shown in FIG. 7.

Figure 11:
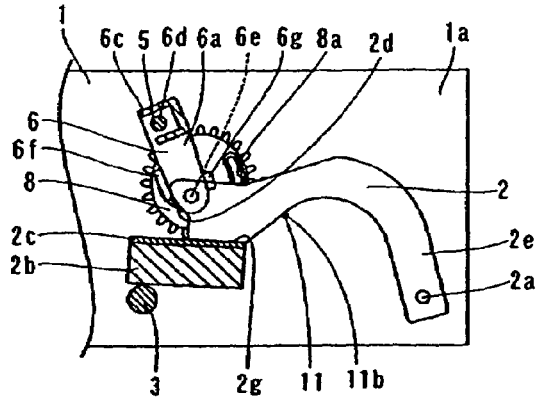
FIG. 11 is a schematic side view showing the positional relationship between the print unit and the first side part of the pivoting member according to the first embodiment of the present invention, when the pivoting member starts pressing the print unit.

Also, in the present embodiment, a movement preventing part 6*g* that protrudes in the direction of the arrow C as shown in FIG. 2 is integrally and unitarily provided to the first side part 6*a* of the pivoting member 6. It is thereby possible to reduce the space between the movement preventing part 6*g* and the first arm 2*e* of the print unit 2 to about 0.3 mm, as shown in FIG. 2. The movement preventing part 6*g* is capable of coming into contact with the first arm 2*e* of the print unit 2 in the side wise direction, when the thermal head unit 2*b* is pressed and when the thermal head unit 2*b* is not pressed on the platen roller 3, as shown in FIGS. 7 and 11. It is thereby possible to prevent the pivoting member 6 from moving in the direction of the arrow C in FIG. 2 in either case.

Figure 4:
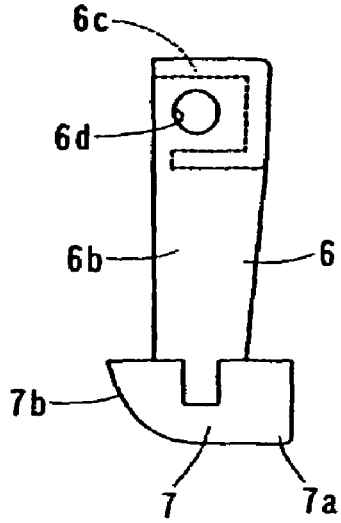
FIG. 4 is a side view of the pivoting member of the image forming apparatus according to the first embodiment of the present invention.
Figure 13:
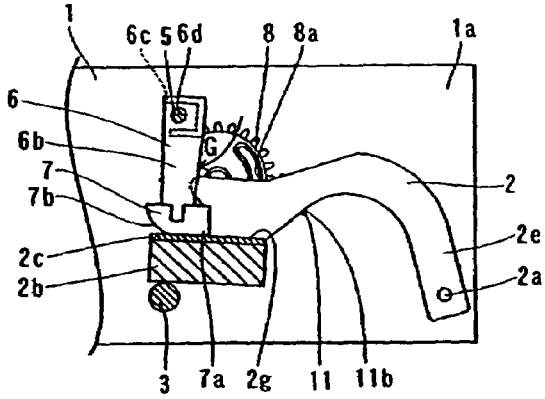
FIG. 13 is a schematic side view showing the positional relationship between the print unit and the second side part of the pivoting member according to the first embodiment of the present invention, when the pivoting member is pressing the print unit.

Also, in the present embodiment, a resinous pressing part 7 is mounted at the distal end of the second side part 6*b* of the pivoting member 6, as shown in FIG. 4. A pivot stopper 7*a* (an example of the flat portion), which prevents the pressing part 7 from pivoting in the direction of arrow E) beyond a specific angular range during the pressing operation, is integrally and unilaterally provided to the pressing part 7. This pivot stopper 7*a* comes into contact with the top surface 2*g* of the heat sink 2*c* during the pressing operation, as shown in FIG. 13. It is therefore possible to prevent the pressing part 7 from pivoting beyond a specific angle.

Figure 10:
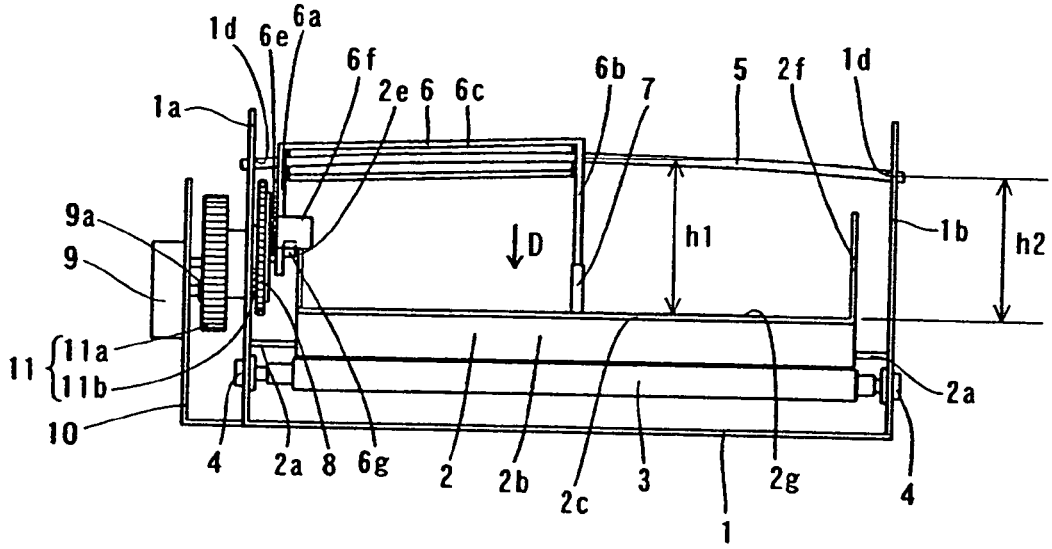
FIG. 10 is a front view of the image forming apparatus according to the first embodiment of the present invention, when the pivoting member presses the print unit.

Also, as shown in FIG. 10, a height h1 from the bottom surface of the pressing part 7 to the center of the hole 6*d* (see FIG. 4) of the second side part 6*b* of the pivoting member 6 during the pressing operation is formed to be about 3 mm greater than the height h2 from the top surface 2*g* of the heat sink 2*c* to the center of the insertion holes 1*d* of the chassis 1. Accordingly, the support rod 5 bends upward by about 3 mm when pressure is applied to the print unit 2.

Figure 8:
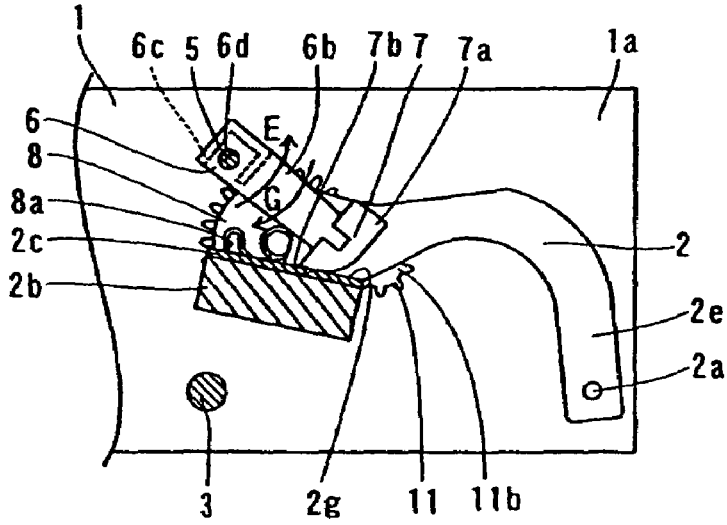
FIG. 8 is a schematic side view showing the positional relationship between the print unit and the second side part of the pivoting member of the image forming apparatus according to the first embodiment of the present invention, when the pivoting member is no pressing the print unit.
Figure 9:
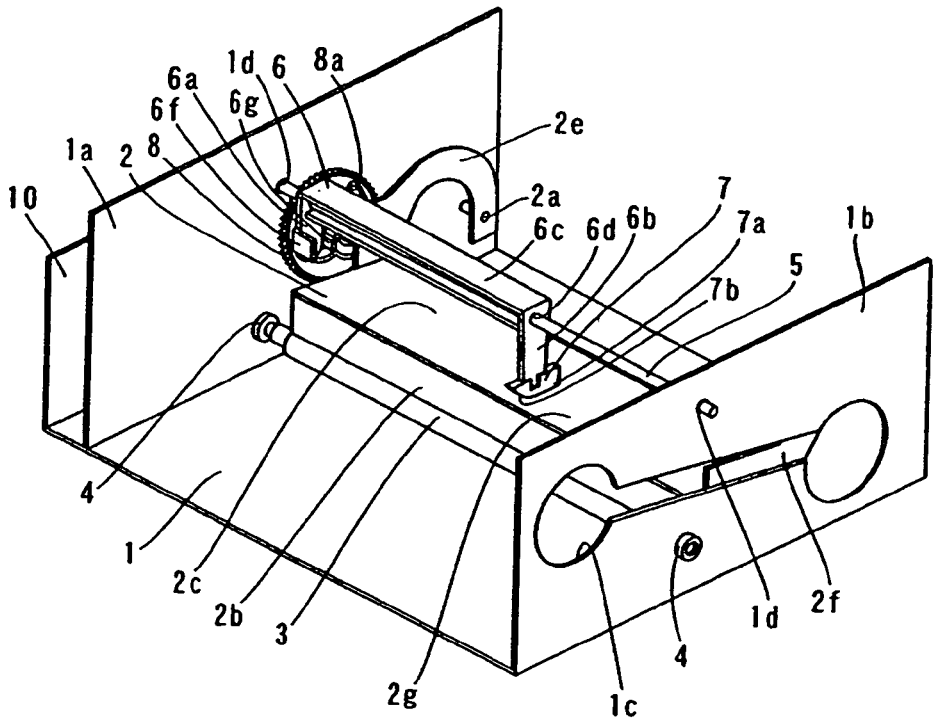
FIG. 9 is a perspective view of the image forming apparatus according to the first embodiment of the present invention, when the pivoting member presses against the print unit.

Also, in the present embodiment, a contact unit 7*b* (an example of the curved portion) is integrally provided to the section of the pressing part 7 on the side of the pivoting direction during the pressing operation (the direction of the arrow G), as shown in FIG. 4. This contact unit 7*b* is formed so as to maintain contact with the top surface 2*g* of the heat sink 2*c* of the print unit 2 when the thermal head unit 2*b* is not pressed against the platen roller 3, as shown in FIG. 8. Also, the pressing part 7 is disposed so as to press on near the center of the print unit 2 in the width direction (the direction A in FIG. 1) as a result of the pivoting, as shown in FIGS. 9 and 10. It is thereby possible to press on the print unit 2 uniformly to the left and right in the width direction of the print unit 2. Therefore, it is possible for the thermal head unit 2*b* to be brought in uniform contact with the platen roller 3.

Figure 5:
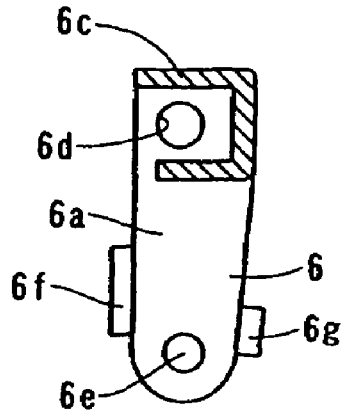
FIG. 5 is a cross-sectional side view of the pivoting member of the image forming apparatus according to the first embodiment of the present invention.
Figure 6:
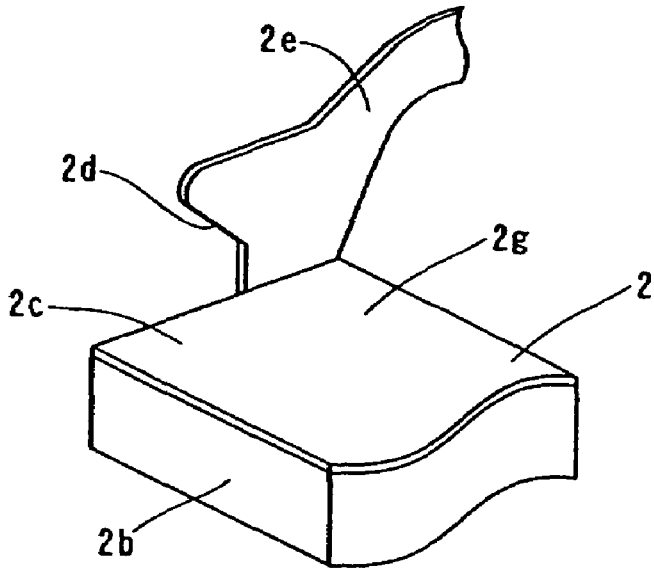
FIG. 6 is a partial perspective view of the engaging part of the print unit of the image forming apparatus according to the first embodiment of the present invention.

Also, the linking part 6*c* of the pivoting member 6 has a cross section in the shape of a U that encloses the support rod 5 (see FIG. 1), as shown in FIGS. 3 through 5. The strength of the linking part 6*c* can be increased due to this U-shaped cross section. It is therefore possible to prevent the first side part 6*a* from being twisted relative to the second side part 6*b*.

The drive gear 8 is mounted on the first side part 1*a* of the chassis 1, as shown in FIG. 2, so as to transmit the drive force from the intermediate gear 11 to the pivoting member 6. The drive force of the motor 9 mounted on the motor bracket 10 is transmitted from the motor axle gear 9*a* to the drive gear 8 via the large gear 11*a* and the small gear 11*b* of the intermediate gear 11.

Next, the operation in which the print unit 2 applies pressure to the platen roller 3 in the heat transfer printer according to the first embodiment of the present invention will be described with reference to FIG. 2 and FIGS. 7 through 13.

First, in the initial state, the pivoting member 6 is pivoted in the direction of the arrow E (or first rotational direction) in FIG. 7, as shown in FIGS. 1, 2, 7, and 8. At this time, the first arm 2*e* is moved upward because the lifting part 6*f* of the pivoting member 6 pushes up the engaging part 2*d* of the first arm 2*e* of the print unit 2, as shown in FIG. 7. The thermal head unit 2*b* is thereby pivoted in the direction away from the platen roller 3 (the direction of the arrow F (or second rotational direction)).

From this state, the drive force of the motor 9 (see FIG. 2) is transmitted from the motor axle gear 9*a* (see FIG. 2) to the first side part 6*a* of the pivoting member 6 via the large gear 11*a* (see FIG. 2) and the small gear 11*b* of the intermediate gear 11, the drive gear 8, and the cam pin 6*e* of the pivoting member 6, which is in engagement with the cam groove 8*a* of the drive gear 8. Accordingly, the first side part 6*a* of the pivoting member 6 is pivoted from the state shown in FIG. 7 to the state shown in FIG. 11, and the second side part 6*b* of the pivoting member 6 is accordingly pivoted in the direction of the arrow G in FIG. 8. Accordingly, the thermal head unit 2*b* of the print unit 2 comes into contact with the platen roller 3, resulting in a transition from the state shown in FIGS. 1 and 8 to the state shown in FIG. 12.

Figure 12:
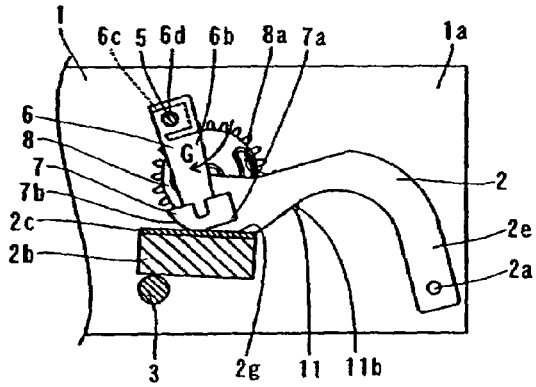
FIG. 12 is a schematic side view showing the positional relationship between the print unit and the second side part of the pivoting member according to the first embodiment of the present invention, when the pivoting member starts pressing the print unit.

The pivoting member 6 is further pivoted in the direction of the arrow G from the state shown in FIG. 12 to the state shown in FIGS. 9 and 13. At this time, the support rod 5 made from a piano wire having a diameter of, for example, about 3 mm bends upward by about 3 mm as shown in FIG. 10. This results in bending stress of, for example, about 30 N to 40 N in the support rod 5. The pressing part 7 is therefore pressed against the top surface 2*g* of the heat sink 2*c* in the direction of the arrow D due to this bending stress. As a result, the thermal head unit 2*b* of the print unit 2 is pressed against the platen roller 3 with a pressure of about 30 N to 40 N.

In the present embodiment, as described above, there is provided a U-shaped pivoting member 6 that has the first side part 6*a* and the second side part 6*b* that is equipped with the pressing part 7 for pressing the thermal head unit 2*b* against the platen roller 3. Furthermore, the elastically deformable support rod 5 is provided for pivotably supporting the pivoting member 6. The pressing part 7 of the pivoting member 6 can press the thermal head unit 2*b* against the platen roller 3 with the urging force that results from the flexural deformation of the support rod 5. There is thereby no need to provide a spring member separate from the support rod 5. Accordingly, the number of components required for pressing the thermal head unit 2*b* against the platen roller 3 can be reduced.

Furthermore, the first side part 6*a* of the pivoting member 6 is integrally provided with the lifting part 6*f*, which is provided for separating the thermal head unit 2*b* from the platen roller 3. Still furthermore, the print unit 2 is provided with the engaging part 2*d*, which is provided for engaging the lifting part 6*f*. Therefore, the number of components can be reduced even further as compared to the case where a member for separating the thermal head unit 2*b* from the platen roller 3 is separately provided.

Also, in the present embodiment, the pressing part 7 of the pivoting member 6 is provided with the contact unit 7*b*, which maintains contact with the top surface 2*g* of the heat sink 2*c* of the print unit 2 when the thermal head unit 2*b* is not pressed against the platen roller 3. Accordingly, the print unit 2 can be prevented from wobbling by being constantly in contact with the pressing part 7.

Also, in the present embodiment, the pressing part 7 of the pivoting member 6 is provided with the pivot stopper 7*a*, which is provided for preventing the pressing part 7 from pivoting beyond a specific angular range while the print unit 2 is either pressed or not pressed by the pressing part 7. Accordingly, the position in which the pressing part 7 of the pivoting member 6 comes into contact with the top surface 2*g* of the heat sink 2*c* of the print unit 2 can be prevented from changing, and the pressure applied to the print unit 2 by the pivoting member 6 can therefore be prevented from changing. The pressure applied to the platen roller 3 by the thermal head unit 2*b* can also be prevented from changing. As a result, printing irregularities can be prevented from occurring.

Also, in the present embodiment, the space between the movement preventing part 6*g* and the first arm 2*e* of the print unit 2 can be reduced by providing the first side part 6*a* of the pivoting member 6 integrally with the movement preventing part 6*g*, which protrudes from the first arm part 6*a* in the direction of the arrow C in FIG. 2. Accordingly, the position at which the pressing part 7 of the pivoting member 6 comes into contact with the top surface 2*g* of the heat sink 2*c* of the print unit 2 can be prevented from shifting along the width direction of the print unit 2 (the direction A in FIG. 1). It is therefore possible to prevent the pressure applied to the print unit 2 by the pivoting member 6 from changing due to the shifting of the position at which the pressing part 7 of the pivoting member 6 comes into contact with the top surface 2*g* of the heat sink 2*c* of the print unit 2. Therefore, printing irregularities can be prevented from occurring.

The embodiment currently disclosed should be considered as an example in all respects and not as being restrictive. The range of the present invention is expressed by the patent claims and not by the above descriptions of the embodiment, and further includes meanings equivalent to the range of the patent claims and all variations within this range.

Figure 14:
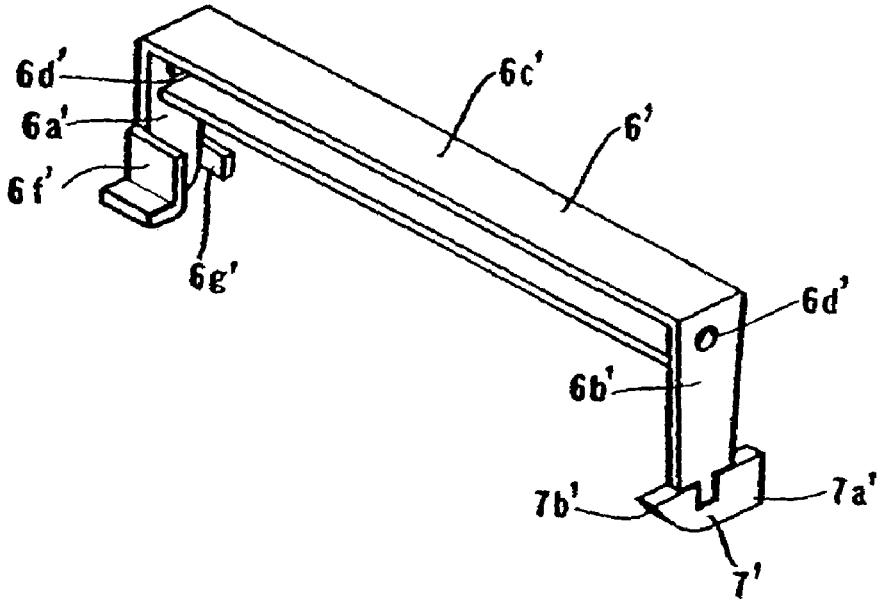
FIG. 14 is a perspective view of the pivoting member according to a second embodiment of the present invention.
Figure 15:
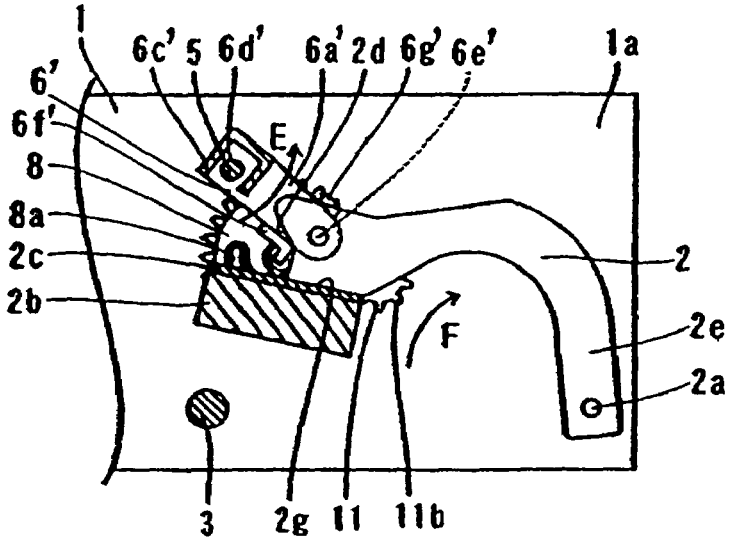
FIG. 15 is a schematic side view showing the positional relationship between the print unit and the first side part of the pivoting member of the image forming apparatus according to the second embodiment of the present invention, when the pivoting member is not pressing the print unit.
Figure 16:
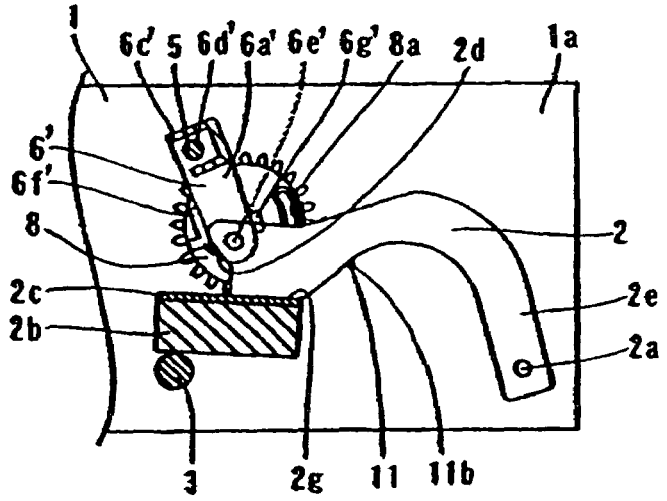
FIG. 16 is a schematic side view showing the positional relationship between the print unit and the first side part of the pivoting member according to the first embodiment of the present invention, when the pivoting member starts pressing the print unit.
Figure 17:
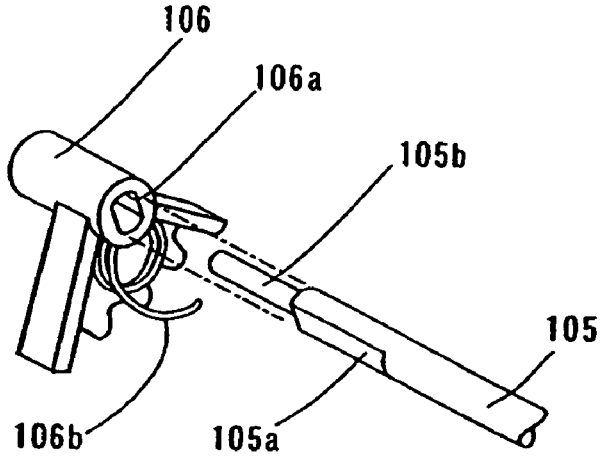
Figure 17 PRIOR ART
FIG. 17 is a perspective view illustrating the mounting structure of the pressing member and the shaft in a conventional heat transfer printer.
Figure 18:
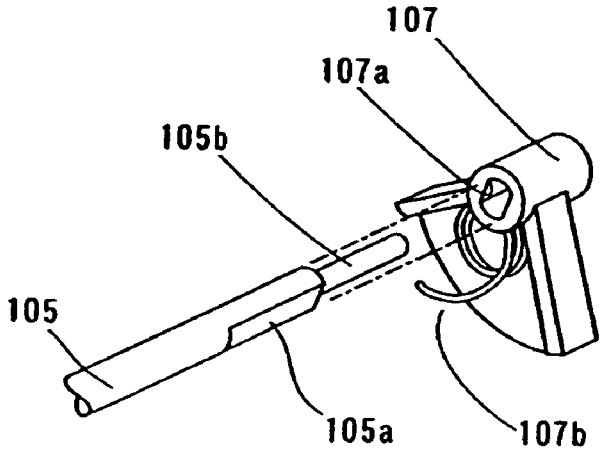
FIG. 18 is a perspective view illustrating the mounting structure of the pressing member and the shaft in the conventional heat transfer printer shown in FIGS. 14 and 15.
Figure 19:
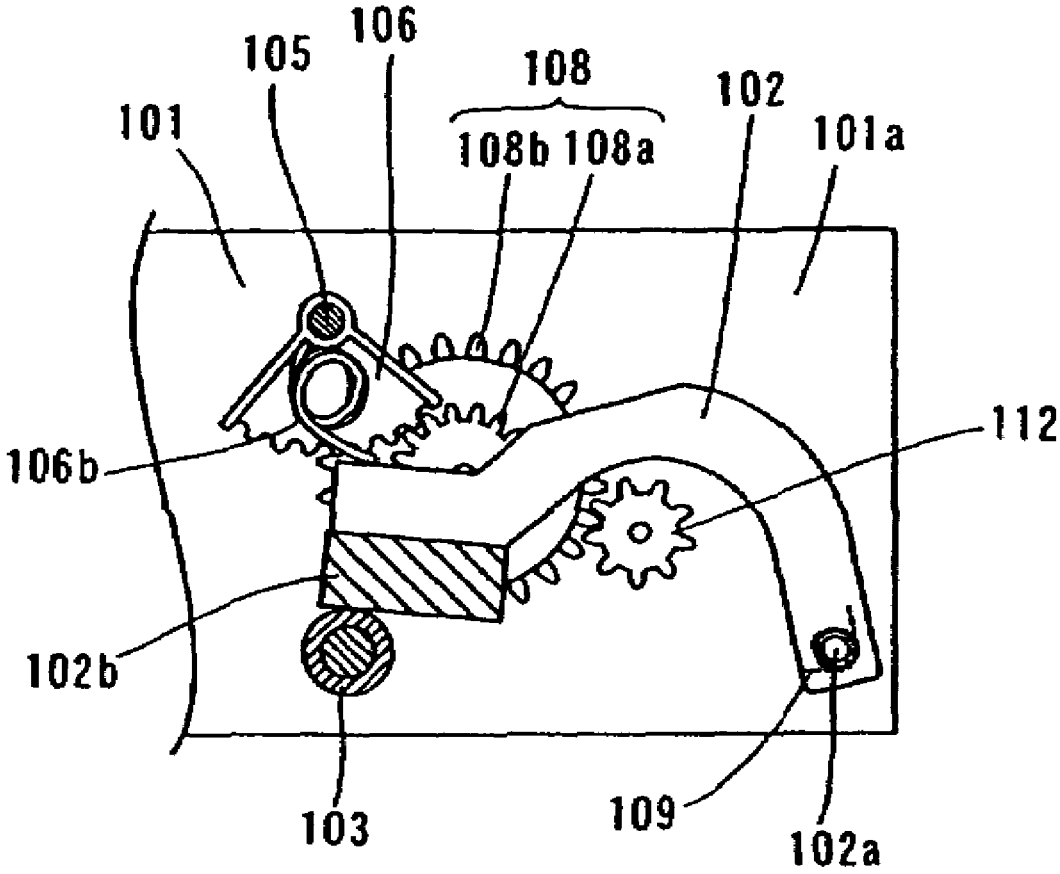
PRIOR ART Figure 19
FIG. 19 is a cross-sectional view illustrating the operation in which the print unit applies pressure to the platen roller in the conventional heat transfer printer shown in FIGS. 14 and 15.

FIG. 14 shows a pivoting member 6' of an image forming apparatus in accordance with an alternate embodiment of the present invention. In this pivoting member 6', the lifting part 6*f'* has an L-shape with a rounded corner. As shown in FIGS. 15 and 16, the rounded corner of the L-shaped lifting part 6*f'* attaches the engaging part 2*d* of the print unit 2. In this way, the lifting part 6*f'* of the pivoting member 6' can lift up the engaging part 2*d* of the print unit 2 even more smoothly.

Additionally the lifting projection such as the lifting part 6*f* and the lifting part 6*f'* and the downward facing portion such as the engaging portion 2*d* are not limited to the shapes disclosed in the above described embodiments.

For example, in the embodiment described above, a heat transfer printer is given as an example of an image forming apparatus. However, the present invention is not limited thereto, and can also be applied to image forming apparatuses other than heat transfer printers as long as such image forming apparatus has a member for pressing the print head element against a platen roller.

Also, in the embodiment described above, an example is given in which the pressing part is formed separately from the pivoting member. However, the present invention is not limited thereto, and the pressing part may also be provided integrally with the pivoting member.

Furthermore, in the embodiment described above, an example is given in which the movement preventing part is provided to the first side surface of the pivoting member.

However, the present invention is not limited thereto, and the movement preventing part may also be provided to other portion of the pivoting member.

Also, in the embodiment described above, an example is given in which one elastically deformable support rod is used. However, the present invention is not limited thereto, and two or more elastically deformable support rods may also be used.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus comprising:

a chassis;

a print unit pivotally supported by the chassis and having arm portions and a print head element supported by the arm portions, one of the arm portions having a downward facing portion;

a platen roller rotatably supported by the chassis so as to face the print unit;

a motor;

an elastically deformable support rod supported by the chassis; and a pivoting member rotatably supported by the support rod and having a first side part that is configured to receive driving force from the motor in first and second rotational directions, and a second side part that is relatively non-rotatably coupled to the first side part, the first and second rotational directions being opposite rotational directions, the first side part being integrally provided with a lifting projection, the lifting projection of the pivoting member being configured to engage the downward facing portion of the print unit from below and pivot the print unit in the second rotational direction away from the platen roller while the pivoting member is pivoted in the first rotational direction, the second side part being provided with a pressing part, which is configured to press the print head element against the platen roller when the pivoting member is pivoted in the second rotational direction.

2. The image forming apparatus according to claim 1, wherein the pressing part of the pivoting member includes a curved portion that maintains contact with the print unit when the pivoting member is pivoted in the first rotational direction and the print unit is separated from the platen roller.

3. The image forming apparatus according to claim 1, wherein the pressing part of the pivoting member includes a flat portion, the pivoting member being prevented from pivoting further in the second rotational direction when the flat portion presses the print unit.

4. The image forming apparatus according to claim 1, wherein the pivoting member is integrally provided with a movement preventing projection that is configured to abut on the arm portion of the print unit from the side.

5. The image forming apparatus according to claim 1, wherein the pressing part is configured to press the print head element against the platen roller with a biasing force from elastic deformation of the support rod when the pivoting member is pivoted in the second rotational direction.

6. The image forming apparatus according to claim 1, wherein the lifting projection is a plate shaped projection.

7. The image forming apparatus according to claim 1, wherein the lifting projection is a L-shaped projection with a rounded corner.

8. The image forming apparatus according to claim 1, wherein the pivoting member has a U-shaped cross section.

9. An image forming apparatus comprising:

a chassis;

a print unit pivotally supported by the chassis and having arm portions and a print head element supported by the arm portions, one of the arm portions having a downward facing portion;

a platen roller rotatably supported by the chassis so as to face the print unit;

a motor;

an elastically deformable support rod supported by the chassis; and a pivoting member rotatably supported by the support rod and having a first side part that is configured to receive driving force from the motor in first and second rotational directions, and a second side part that is relatively non-rotatably coupled to the first side part, the pivoting member having a U-shaped cross sectional shape, the first and second rotational directions being opposite rotational directions, the first side part being integrally provided with a L-shaped lifting projection, the lifting projection of the pivoting member selectively engaging the downward facing portion of the print unit from below and pivot the print unit in the second rotational direction away from the platen roller while the pivoting member is pivoted in the first rotational direction, the second side part being provided with a pressing part, which is configured to press the print head element against the platen roller when the pivoting member is pivoted in the second rotational direction, the pressing part of the pivoting member including a curved portion that maintains contact with the print unit when the pivoting member is pivoted in the first rotational direction and the print unit is separated from the platen roller, and a flat portion, the pivoting member being prevented from pivoting further in the second rotational direction when the flat portion presses the print unit, the pivoting member being integrally provided with a movement preventing projection that is configured to abut on the arm portion of the print unit from the side, the pressing part pressing the print head element against the platen roller with a biasing force from elastic deformation of the support rod when the pivoting member is pivoted in the second rotational direction.

* * * * *